United States Patent [19]

Paulsen et al.

[11] 4,226,187

[45] Oct. 7, 1980

[54] SKI LIFT APPARATUS AND SAFETY DEVICE

[75] Inventors: Rex E. Paulsen, Littleton; Harold Moser, Denver, both of Colo.

[73] Assignee: SDI Welding Corporation, Dillon, Colo.

[21] Appl. No.: 953,355

[22] Filed: Oct. 23, 1978

[51] Int. Cl.[3] ..... B61B 11/00

[52] U.S. Cl. ..... 104/182; 104/115; 104/173 ST

[58] Field of Search ..... 104/182, 173 ST, 179, 104/197, 115, 116, 112; 267/57.1 R, 57.1 A, 154

[56] References Cited

U.S. PATENT DOCUMENTS

| | | | |
|---|---|---|---|
| 3,339,497 | 9/1967 | Bancel | 104/173 ST |
| 3,436,069 | 4/1969 | Henschen | 267/57.1 R |

FOREIGN PATENT DOCUMENTS

| | | | |
|---|---|---|---|
| 817506 | 9/1937 | France | 104/173 ST |
| 2276971 | 1/1976 | France | 104/115 |
| 2389523 | 12/1978 | France | 104/182 |

*Primary Examiner*—John J. Love
*Assistant Examiner*—Ross Weaver
*Attorney, Agent, or Firm*—Sheridan, Ross, Field & McIntosh

[57] ABSTRACT

The safety equipment is used in conjunction with a conventional ski lift system having a series of towers plus turnaround stations, arms extending out from the towers, and single or multiple bogey beams, each having at least two rope support sheaves. A continuous cable, or rope, extends over all of the support sheaves and around the end stations. The safety features include a secondary sheave mounted beside and outward of the primary sheaves with its upper margin below the upper margins of the primary sheaves. If a rope is displaced from the primary sheaves it will fall into the groove on the secondary sheave. To prevent displacement from the secondary sheave, a star wheel is mounted above the sheaves for rotation on a horizontal axis and the radial fingers pass down close to the outside of the secondary sheave and overlap its upper portion. The gap between the sheave and the guard fingers is so small that a rope cannot fall between them. As each vehicle approaches the support assembly its laterally extending hanger arm strikes a guard finger and produces a partial turn of the star wheel. Enough fingers are provided so that the rope will always be guarded by two or three fingers.

10 Claims, 9 Drawing Figures

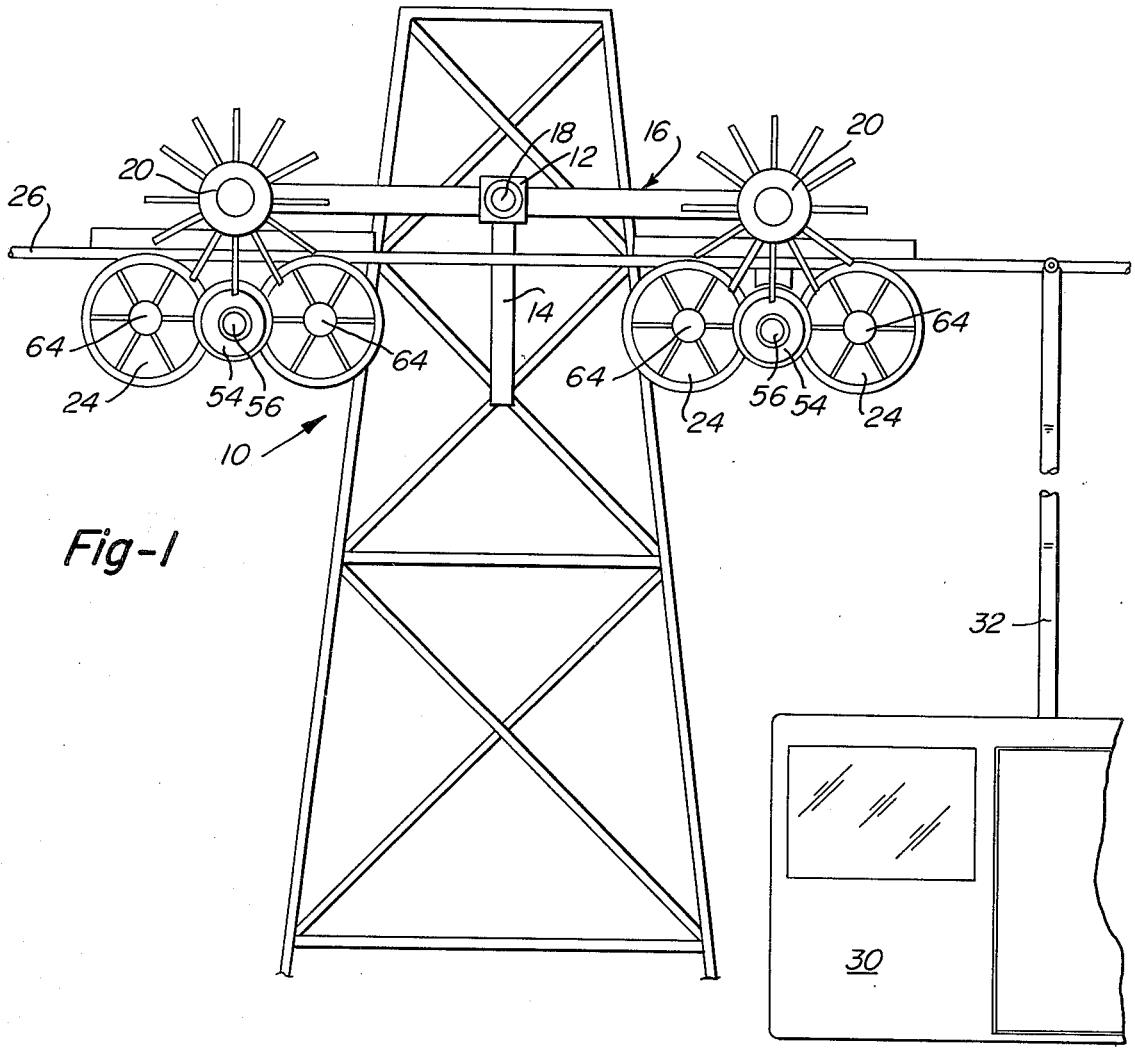
Fig-1
Fig-2
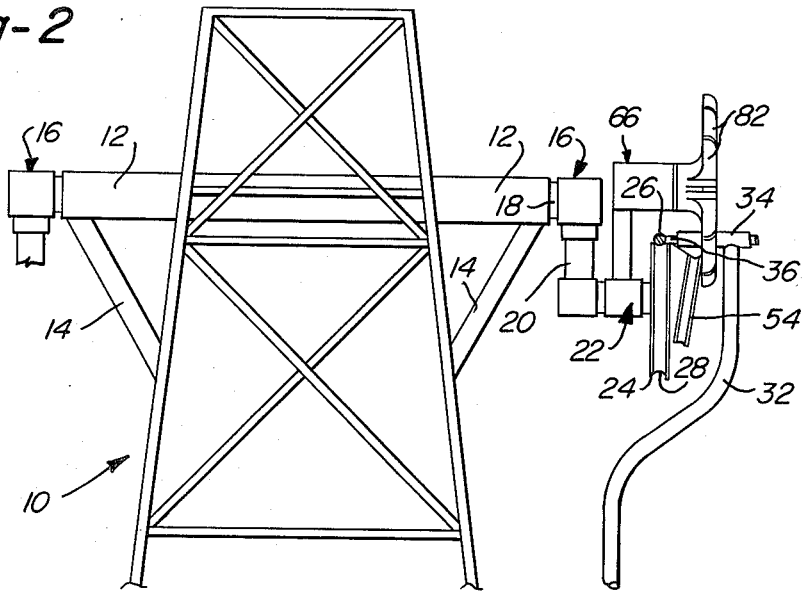

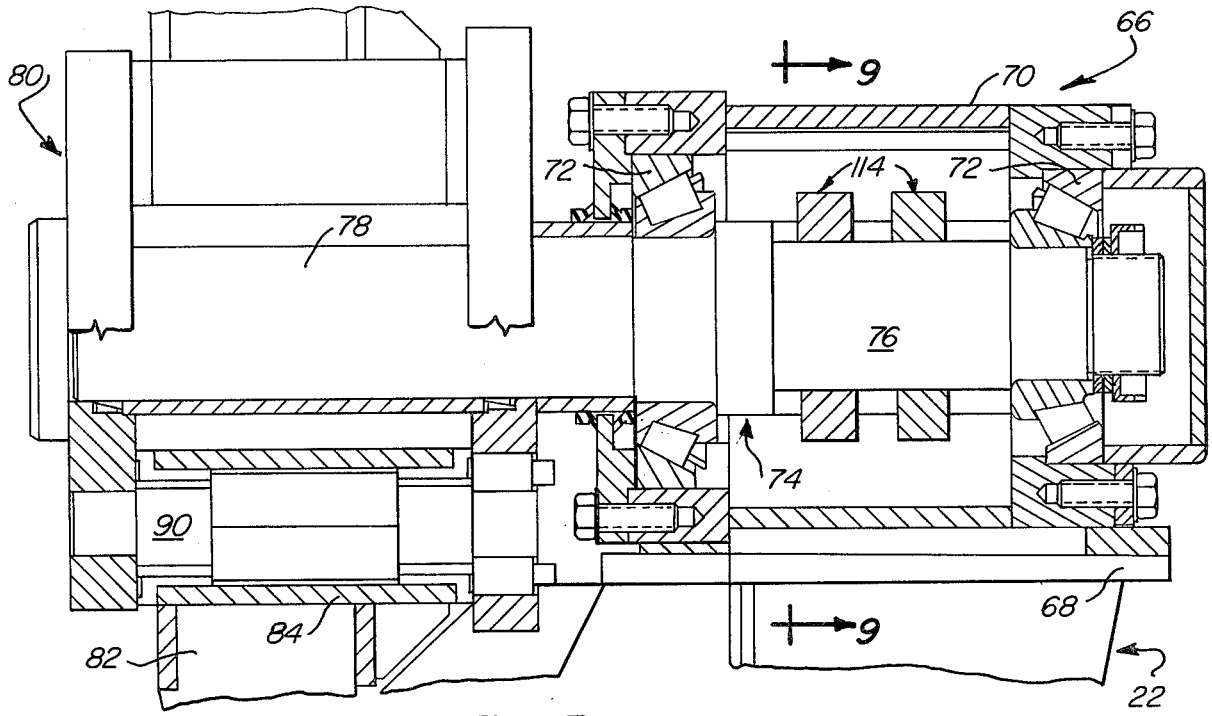
Fig-5
Fig-4
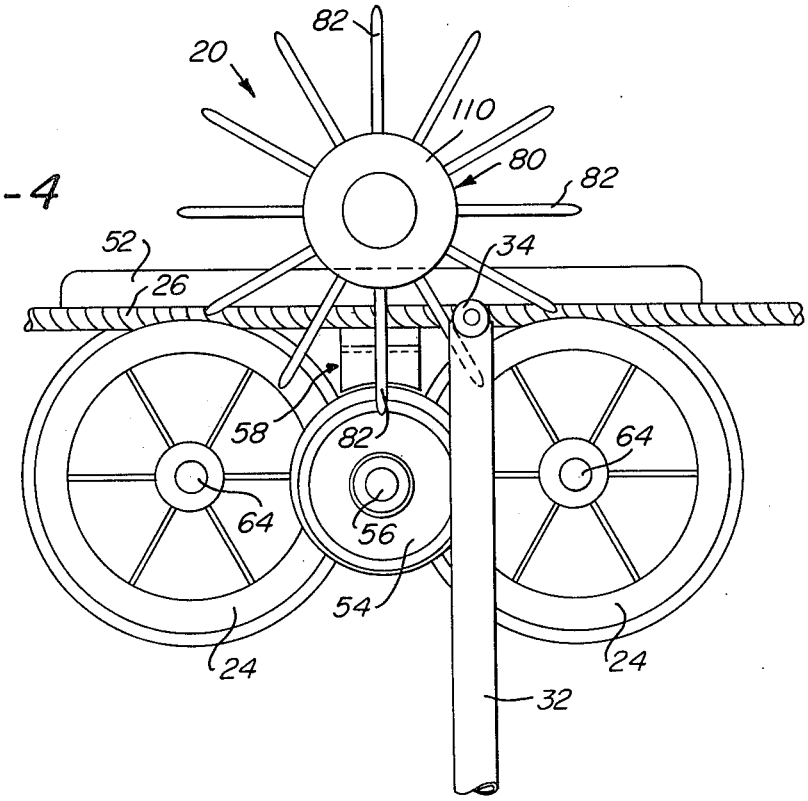

Fig-9
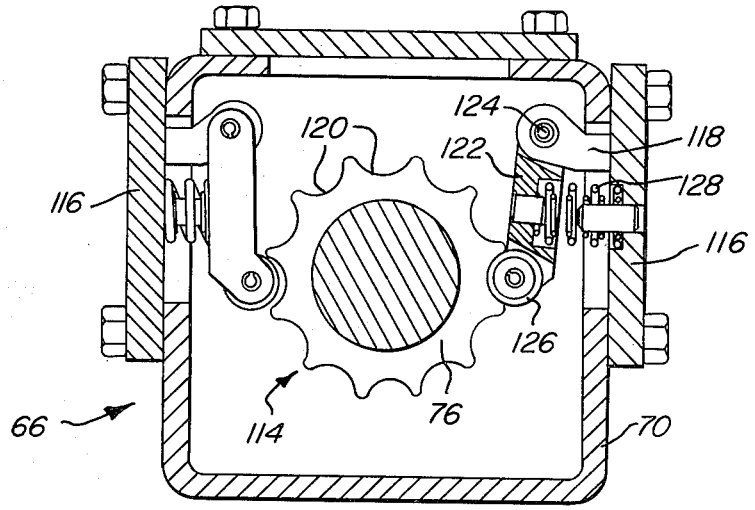
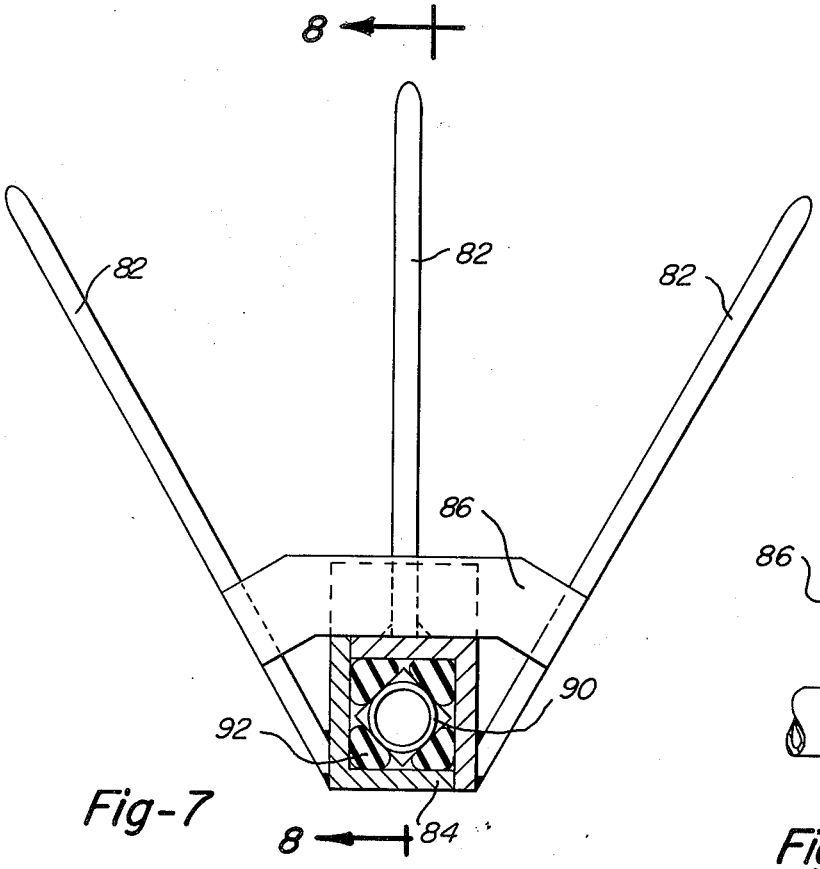
Fig-7
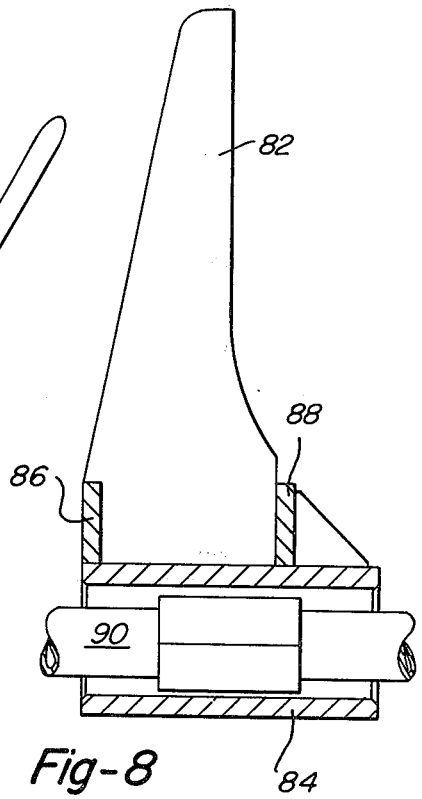
Fig-8

SKI LIFT APPARATUS AND SAFETY DEVICE

BACKGROUND OF THE INVENTION

This invention lies in the field of ski lift and equivalent transport apparatus and is directed to means for preventing vehicle carrying ropes from being dislodged and falling from the rope-support assemblies. It is more particularly directed toward apparatus for guarding the margins of sheaves to prevent dislodgement of the ropes while not interfering with normal operation of the total apparatus.

In conventional ski lifts, a series of towers is provided along with turnaround stations at each end of a route segment. Arms extend out to each side of each tower and pivotally carry bogey beams which in turn carry sheaves. An endless cable, or rope, extends around the bull wheel at each turnaround station and rides in the grooves of the sheaves supported by the towers. The passenger carrying vehicles are usually supported by a generally vertical hanger bar having at its upper end a transversely extending hanger arm, the free end of which is fixedly attached to a selected point on the rope.

The hanger arm and its attachment to the rope constitute enlargements on the rope which set up a disturbance when they strike a sheave. Operation of the power plant may cause vibration in the rope, and wind action on the vehicles and rope often causes both vertical and horizontal fluctuations. When these actions happen to combine in certain ways the disturbance can be sufficient to dislodge the rope from the supporting sheaves and let it drop to the ground.

Various schemes have been proposed and put into practice for overcoming this difficulty. Some have been satisfactory but were complicated and expensive or difficult to apply to existing installations. Others were simple but not very satisfactory. One type simply provides a shelf or bracket beside a pair of supporting sheaves which may catch the rope if it falls from the sheaves. Another provides a bracket extending logitudinally above the sheaves and carrying a series of rollers which contact the rope and tend to hold it in the sheaves. Another has a series of arms carried by supports rotating on a vertical axis, the arms underlying the rope and and being displaced by contact with the hanger bar. Another type of apparatus used stationary rope hung from the supports by short cables and the vehicle has motive power to cause it to move along the rope. Its supporting wheels are disk-like and overlie the cable from opposite sides being formed with radial arms to pass the supporting cables for the rope.

PRIOR ART STATEMENT

The following references are submitted under the provisions of 37CRF 1.97 (b) as having come to the attention of Applicant:

U.S. Pat. No. 3,274,954 Doppelmayr;
U.S. Pat. No. 3,382,816 Goforth;
U.S. Pat. No. 3,459,138 Grieve;
U.S. Pat. No. 1,295,485 Hall.

These references are generally illustrative of what has been proposed before.

Doppelmayr proposes an apparatus having a pair of rope-carrier sheaves on a bogey beam to support the rope under normal conditions of operation. A shelf or bracket is mounted at the side of the rope-carrier sheaves remote from the tower in a position to catch the rope if it is displaced from the sheaves. The high friction between the rope and the bracket can severely damage the rope before the lift apparatus is stopped, and there is no guard of any kind to prevent further displacement of the rope from the bracket.

Goforth proposes an apparatus having a bracket extending longitudinally above the sheaves and carrying a series of rollers which contact the rope and tend to hold it in the sheaves. The rollers must be spaced from the sheaves sufficiently to allow the passage of the enlargements where the vehicle hangers are attached and therefore thay cannot be a close fit on the rope, which is likely to escape when disturbed.

Grieve proposes an apparatus in which a series of arms are attached to a support mounted for rotation on a vertical axis. One support is located to each side of the rope and the radial arms underlie the rope to catch it if it falls from the sheaves. The arms are rotationally displaced by contact with the vehicle hanger, but there are always a plurality of arms underlying the rope. Thus the apparatus performs its intended function but it is unduly complicated and subject to damage and failure.

Hall proposes another type of apparatus which uses stationary rope hung from the supports by short cables, and the vehicle has motive power to cause it to move along the rope. Its supporting wheels are disk-like and overlie the cable from opposite sides, being formed with radial arms to pass the supporting cables for the rope. While this system is also workable, it is extremely complicated and has a tendency to cause severe wear on the rope, leading to failure.

SUMMARY OF THE INVENTION

The present invention provides apparatus which positively prevent loss of ropes from the tower supports, is relatively simple in construction and operation, and can readily be applied to many different types of ski lift apparatus now in operation.

Generally stated, in its presently preferred form, the invention is applied to a conventional ski lift apparatus which has a plurality of towers, each with rope-carrier assemblies. One such assembly may include a bogey beam pivotally mounted on supporting structure and having a pair of longitudinally spaced primary sheaves to receive and retain a continuous rope traveling the length of the apparatus. Immediately outward of the primary sheaves a secondary sheave is mounted. It rotates on an axle in a bracket which is secured in the existing structure and is connected thereby to the bogey beam. The axis of rotation of the secondary sheave is generally parallel to the axes of the primary sheaves. It is located longitudinally between them and preferably midway. Since the primary sheaves are large and close together, the secondary sheave overlaps both of them. It is somewhat smaller in diameter and thus its upper margin is below the upper margins of the primary sheaves. A plate-like shield is located close to the inboard sides of the primary sheaves and extends some distance above their upper margins so there is no possibility of the rope being displaced inward toward the towers.

If a disturbance is sufficient to dislodge the rope from the primary sheaves outboard it will then fall into the groove of the secondary pulley and the apparatus can still operate. A guide member is provided which slopes downward and outward and guides the rope directly into the groove. In order to insure that the rope cannot be displaced outward and downward from the secondary sheave a rope guard mechanism is provided. It includes a base connected to the beam and a plurality of guard fingers movably mounted on the base. These could be individual fingers longitudinally spaced and movable longitudinally by contact with the hanger arm, or they could be longitudinally fixed but swing about lateral pivots. However, it is preferred to mount a rotatable shaft in bearings on the base with the shaft axis well above all of the sheaves and to mount a star wheel on the shaft sized and located so that its guard fingers will swing down just outboard of the secondary sheave, overlapping its diameter and being spaced a distance far less than the diameter of the rope. The star wheel may have a dozen or more guard fingers so that there will always be two or more fingers overlapping the sheave and blocking dislodgement of the rope at all times. A fixed guard plate cannot be maintained at the outboard side because there must be passage for the hanger bars of the lift vehicles. The star wheel does the necessary blocking but the guard fingers are readily displaceable by the hanger arms. As each finger swings up and out of range another comes down to maintain the desired protection.

BRIEF DESCRIPTION OF THE DRAWINGS

Various other advantages and features of novelty will become apparent as the description proceeds in conjunction with the accompanying drawings, in which:

FIG. 1 is a side elevational view of a ski lift apparatus incorporating the safety device of the invention;

FIG. 2 is an end elevational view of the apparatus of FIG. 1;

FIG. 4 is a side elevational view of the apparatus of FIG. 3;

FIG. 5 is a vertical sectional view of the safety device;

FIG. 7 is a front elevational view, partly in section, of a mounted group of related guard fingers;

FIG. 8 is a sectional view taken on line 8—8 of FIG. 7; and

FIG. 9 is a sectional view taken on line 9—9 of FIG. 5.

DESCRIPTION OF PREFERRED EMBODIMENTS

Figure 3:
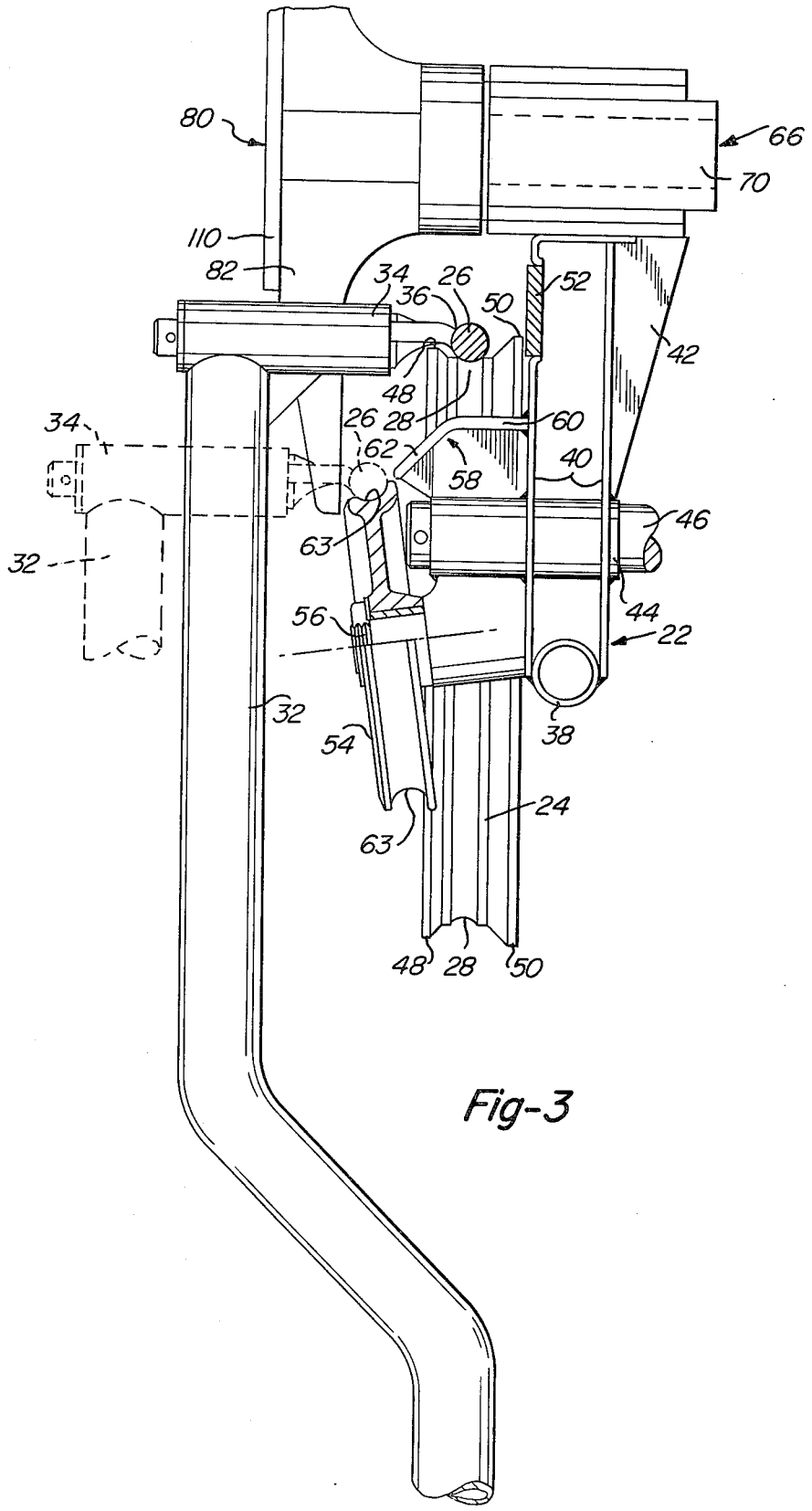
FIG. 3 is an end elevational view, partly in section, of the rope-carrier assembly with the safety device in place.

A portion of a conventional ski lift with a continuous cable or rope and a vehicle for passengers is schematically illustrated in FIGS. 1 and 2, in which an intermediate tower or main support 10 is provided with oppositely extending support members 12 braced by diagonal members 14. A primary bogey beam 16 is pivotally connected at 18 to the outer end of each support member 12, and a depending arm 20 is provided at each end of the primary bogey beam. A secondary bogey beam 22, FIG. 3, is connected at its midpoint to each arm 20 by a shaft and bearing pivotal connection. Thus beam 22 is free to adjust its angle to correspond to any vertical angle which may be required to support the traveling rope.

A primary sheave 24 is rotatably mounted at each end of beam 22, and the endless cable or rope 26 is normally seated in the grooves 28 of the sheaves, which support the rope for translation. A series of vehicles are carried by the rope for transporting passengers from one station to another. The vehicles may be of any type including single or double chairs but for illustrative purposes one is shown as a small car 30 which is supported above ground level by a generally vertical hanger bar 32 provided at its upper end with a laterally extending hanger arm 34, with the free end of the arm being fixedly secured to the rope 26 by clamping or other connection 36. As is conventional, the hanger bar has a double bend to cause the center of gravity of the car to be normally substantially directly under the rope.

Beam 22 is a composite structure which includes a horizontal tubular member 38, parallel vertical bracing straps 40, and rigid stays 42. A support bearing 44 is formed in the support structure and receives the shank or axle 46 which extends forward from arm 20 to mount the structure in place.

As can be seen in FIG. 3, the primary sheaves have unequal flanges. The outer flange 48 is quite narrow because there must be adequate clearance for the inner end of arm 34 which is substantially horizontal. Consequently, if rope 26 is very greatly disturbed it can leave groove 28 and move outwardly over flange 48 and fall toward the ground. The inner flange 50 on the other hand can be much wider, as is shown, because it will not interfere with passage of hanger arm 34. It thus effectively prevents the escape of rope 26 inwardly. As further assurance, a rear guard plate 52 is built into the beam structure, as seen in FIGS. 3 and 4, and is of such length that it extends across the back of both sheaves as well as above the upper margins of the sheaves. The lateral gap between the plate and the sheaves is much less than the diameter of the rope so that the barrier is totally effective. The gap may be of the order of one quarter inch.

One component in the equipment to prevent the displacement of rope 26 outward from the rope-carrier assembly is the secondary sheave 54. This sheave is mounted in a position outboard of the primary sheaves on an axle 56 which, as seen in FIG. 4, lies between the longitudinally spaced primary sheaves. Since the diameter of sheave 54 is less than that of the others its upper margin lies well below the outer upper margins of sheaves 24 and the normal operating position of rope 26. A guide member 58 is fixedly connected to the beam structure 38, 40, 42 by welding or other suitable means and has a horizontal portion 60 and a portion 62 which slopes outward and downward between the primary sheaves to the upper margin of sheave 54. In the event that the rope should be displaced outwardly from the rope-carrier assembly of the primary sheaves it will drop and be guided by guide portion 62 into the groove 63 of sheave 54. Axle 56 may be parallel to the axles 64 of the primary sheaves but it is preferred to cant the axle slightly so that the plane of sheave 54 will be angled downwardly and inwardly at an angle of the order of 8 degrees to furnish clearance for hanger bar 32 if the vehicle rocks laterally. The lower portion can fall within the general plane of the primary sheaves because of the longitudinal gap between them.

The other component of the rope guard assembly is the mechanism which sets up a positive barrier to outward lateral displacement from the rope-carrier assembly of the primary sheaves or from the more comprehensive rope-carrier assembly including the secondary sheave. The latter arrangement is illustrated.

Considering FIGS. 3 and 5 it will be seen that a base 66 is provided which includes a base plate 68 secured to the upper part of the beam 22, and enclosure 70 carried by the base plate and surrounding a bearing mounting which includes two tapered roller bearings 72. An elongate shaft 74 has an inner portion 76 extending into the enclosure and an outer portion 78 exterior of the enclosure, on which is mounted a hub 80. A plurality of guard fingers 82 are carried by the hub and extend radially outward. As seen in FIG. 3, the total base and hub are of such length and the base is so located on the beam that the plane in which the fingers 82 move is immediately outboard of sheave 54. If the rope 26 has fallen onto sheave 54 and is again disturbed before the lift has been stopped there is no possibility of the rope moving straight out becuase finger 82 is a barrier and it cannot drop out and down because the clearance gap is far smaller than the diameter of the rope. Each finger, acting as a cantilever beam, can resist many thousands of pounds of outward pressure.

Clearly a fixed shield or a rotating disk would serve to prevent loss of the rope from the sheave but either would block passage of the hanger arms which effectively extend horizontally out from the rope. Hence, a movable barrier is provided which consists of a plurality of guard fingers which are spaced from each other, with several lying alonside the sheave and the rope at any time. These fingers are displaceable in the direction of the movement of the rope in response to contact by the hanger arm. They may be fixed in position and swing out of the way on pivots, or they may be movable longitudinally on a track with a return course, but it has been determined that it is more desirable to mount a plurality of radially directed fingers on a hub to define a star wheel which will rotate step by step as the fingers are contacted by the hanger arm. Enough fingers are provided so that at all times two or more fingers will overlap the rope and sheave to serve as a barricade.

Since the entire movable portion of the ski lift apparatus represents a very large mass it follows that the hanger arms will strike the guard fingers with great force. Since these fingers must have considerably depth in the direction parallel to the axis of shaft 74 in order to resist the outward forces it is desirable to make them relatively thin in the peripheral direction. Therefore, in order to reduce the shock force on these blades they are resiliently mounted to the hub as generally illustrated in FIGS. 6, 7 and 8.

It will be seen that the fingers are divided into groups of three, welded to a hollow tube 84 which has a square or other non-circular cross section, and also welded to bracing members 86 and 88. The tube in turn is arranged over shank 90 which is also non-circular and the two components are maintained in assembled relation by filling the triangular gaps with bodies of elastomeric material 92. The turning moment of the shock force on any one of the fingers will rotate the tube with respect to the shank and compress bodies 92 which will yield elastically and return the tube to its original relative position. As an alternative, the gaps may be filled with an elastomer which is cured and bonded in place.

Figure 6:
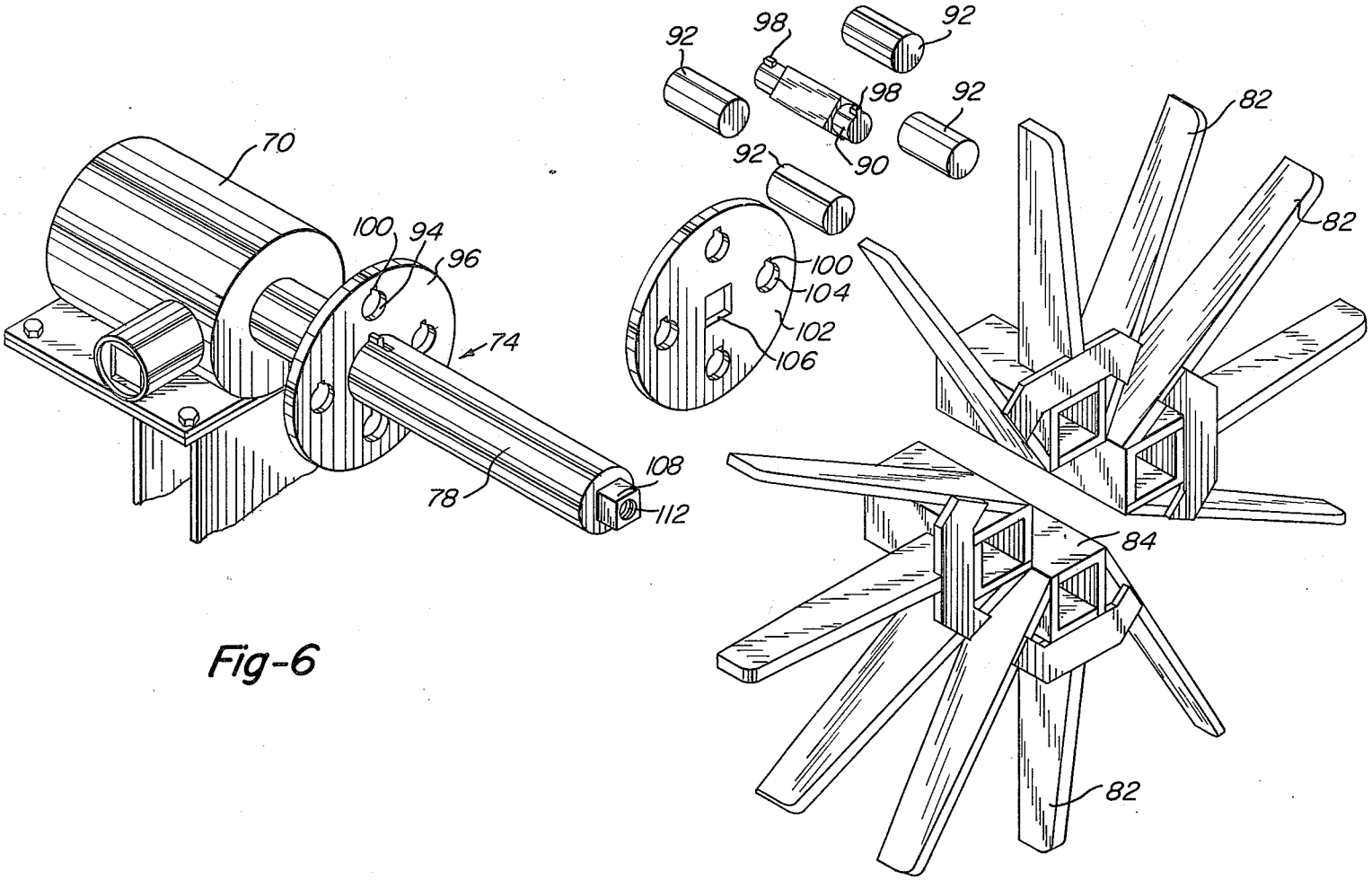
FIG. 6 is an exploded perspective view of the safety device.

The total star wheel assembly is produced in the manner illustrated in FIG. 6. In this particular design four groups of fingers as shown in FIG. 7 are arranged in peripheral spaced relation to form a star wheel. The shanks 90 are cylindrical at each end, and each shank fits into apertures 94 in the inner end plate 96 which is keyed on shaft 74. Each shank end has a key 98 which engages keyway 100 in the end plate to prevent relative rotation of the shank. When the groups of fingers are mounted in position, the outer end plate 102 with apertures 104 is mounted by its squared aperture 106 on the squared end 108 of shaft 74, and the outer ends of shanks 90 enter apertures 104 in the end plate and are keyed in place. A further plate 110 serving as a washer may be mounted in front of end plate 102 and secured by a bolt, not shown, in threaded bore 112 in the end of shaft 74. When the components are all locked together a completely resilient star wheel is produced. Any rotational shock on any one guard finger will cause a limited amount of rotation of the group about the respective shaft 90 while the other groups are not disturbed.

If the star wheel were completely free to turn when a finger is struck by a hanger arm then its random movement after a hanger arm has passed might well result in the undesirable positioning of the next finger to be engaged by a hanger arm. If the tip of such finger is rather close to the level of the rope it may be struck by the hanger arm and the column component of the shock force could buckle the finger. To prevent such possibility a yieldable detent system is provided as shown in FIGS. 5 and 9.

The inner shaft portion 76 of the star wheel shaft 74 is provided with a pair of cam means or members 114 which are fixed against rotation with respect to the shaft. Each cam member has a peripherally spaced series of depressions 120 in its outer rim equal in number to the number of guard fingers, in this case twelve. One or more spring loaded cam followers are located within the enclosure 70 and mounted on side cover plates 116. The assembly includes a bracket 118 fixedly mounted on the cover plate, a cam follower arm 122 pivotally mounted on the bracket at 124, and a roller 126 rotatably mounted on the arm 122 and sized and arranged to selectively seat in one of the depressions 120. A spring 128 between the arm and the cover plate yieldingly urges the arm inward and the roller into the bottom of the depression. When shaft 76 is rotated by external force, the cam depression slope will force the roller radially outward and it will enter each successive depression so that it will yieldingly maintain the star wheel in some selected angular position. Since the star wheel and the cam members are uniform in layout, all of the selected positions will be angularly the same. The cams are arranged on shaft 76 at such angular position that when a roller is seated in a depression the two successive fingers 82 of the star wheel which are nearest to the path of approach of the hanger arm 34 will be so disposed angularly that the tip of one will be above the path of approach and the tip of the other below it at about the same distance. Thus the arm will strike the flat of a finger and not jam against the tip.

What is claimed is:

1. Ski lift apparatus comprising:

a main support;

at least one beam carried by the support;

a rope-carrier assembly mounted on the beam and including at least two peripherally grooved sheaves;

a continuous rope carried by the assembly for translation in the direction of the longitudinal axis of the rope;

a vehicle carrier having a generally vertical hanger bar provided at its upper end with a laterally extending hanger arm fixedly secured at its free end to the rope;

a rope guard mechanism including a base connected to the beam and a plurality of guard fingers movably mounted on the base;

the free ends of the fingers being located adjacent to the rope-carrier assembly at the side remote from the main support and overlapping and spaced laterally from the upper outer margin of at least one of the sheaves a distance substantially less than the diameter of the rope to constitute barriers to positively prevent the rope from falling outward from the assembly;

the guard fingers lying in a generally vertical plane in the path of travel of the hanger arm and being displaceable by contact of the arm about their movable connections with the base in the direction of movement of the arm;

the base includes a bearing mounting;

an enclosure surrounds the mounting;

a rotatable shaft is journaled in the mounting;

a hub is fixed on the outer portion of the shaft; and the guard fingers are mounted on the hub to extend radially and define a star wheel to rotate about the axis of the bearing mounting, and are resiliently connected to the hub for limited angular movement with respect to the hub in response to contact by a hanger arm.

2. Ski lift apparatus comprising:

a main support;

at least one beam carried by the support;

a rope-carrier assembly mounted on the beam and including at least two peripherally grooved sheaves;

a continuous rope carried by the assembly for translation in the direction of the longitudinal axis of the rope;

a vehicle carrier having a generally vertical hanger bar provided at its upper end with a laterally extending hanger arm fixedly secured at its free end to the rope;

a rope guard mechanism including a base connected to the beam and a plurality of guard fingers movably mounted on the base;

the free ends of the fingers being located adjacent to the rope-carrier assembly at the side remote from the main support and overlapping and spaced laterally from the upper outer margin of at least one of the sheaves a distance substantially less than the diameter of the rope to constitute barriers to positively prevent the rope from falling outward from the assembly;

the guard fingers lying in a generally vertical plane in the path of travel of the hanger arm and being displaceable by contact of the arm about their movable connections with the base in the direction of movement of the arm;

the rope-carrier assembly includes at least two primary rope carrying sheaves to normally receive and retain the rope during translation;

and a secondary sheave is also provided and located on the beam at the side of the primary sheaves remote from the main support and with its upper margins at a lower level than the upper outer margins of the primary sheaves to receive and retain the rope on occasions when it leaves the primary sheaves and falls;

the guard fingers of the rope guard mechanism overlap and are closely spaced laterally from the upper outer margin of the secondary sheave; and the axis of rotation of the secondary sheave is generally parallel to the axes of the primary sheaves and located between them in the direction of the paths of travel of the rope.

3. Apparatus as claimed in claim 2; in which the axis of rotation of the secondary sheave is slightly angled to cause the plane of the sheave to extend downward and inward toward the main support to provide clearance for lateral swinging of the hanger bar.

4. Apparatus as claimed in claim 2; in which a guide member is carried by the beam at a point between the primary sheaves and slopes downward and outward to the upper inner margin of the secondary sheave to guide a falling rope into the groove of the secondary sheave.

5. Apparatus as claimed in claim 2; in which the base includes an enclosure surrounding a bearing mounting;

a rotatable shaft is journaled in the bearing mounting;

a hub is fixed on the outer portion of the shaft; and the guard fingers are mounted on the hub to extend radially and define a star wheel to rotate about the axis of the bearing mounting wherein the guard fingers are resiliently connected to the hub for limited angular movement with respect to the hub in response to contact by a hanger arm.

6. A safety device for use in combination with a ski lift apparatus having a main support, at least one beam carried by the support, a rope-carrier assembly mounted on the beam and including at least two peripherally grooved sheaves, a continuous rope carried by the assembly for translation in the direction of the longitudinal axis of the rope, and a vehicle carrier having a generally vertical hanger bar provided at its upper end with a laterally extending hanger arm fixedly secured at its free end to the rope, the device comprising:

a rope guard mechanism having a base formed to be connected to the beam in predetermined position and attitude;

and a plurality of guard fingers movably mounted on the base in such a position that their free ends will be located adjacent to the rope-carrier assembly at the side remote from the main support and spaced laterally from the upper outer margin of at least one of the sheaves a distance substantially less than the diameter of the rope to positively prevent the rope from falling outwardly from the assembly;

the guard fingers lying in a generally vertical plane and being adapted to be located in the path of travel of the hanger arm and being displaceable by contact of the arm about their movable connections with the base in the direction of movement of the arm;

the base includes a bearing mounting;

an enclosure on the base surrounds the bearing mounting;

a rotatable shaft has an inner portion journaled in the bearing mounting and an outer portion extending out of the enclosure;

a hub is fixed on the outer portion of the shaft; and the guard fingers are mounted on the hub to extend radially and define a star wheel to rotate about the axis of the bearing mounting, wherein the guard fingers are resiliently connected to the hub for limited angular movement with respect to the hub in response to contact by a hanger arm.

7. A device as claimed in claim 6; in which the hub comprises inner and outer end plates fixedly mounted on the shaft and a plurality of mounting shanks peripherally spaced around the shaft and extending parallel to and radially spaced from the shaft and fixed against rotation in the end plates;

and the guard fingers are resiliently connected to the shanks for limited peripheral movement in the general plane of the star wheel.

8. A device as claimed in claim 7; in which a plurality of hollow tubes is provided;

one tube surrounds each shank and is resiliently connected thereto;

and a group of guard fingers is fixedly secured to each tube.

9. A device as claimed in claim 8; in which the shanks and the tubes are non-circular in cross section;

the tubes are substantially larger than the shanks;

and the gap between them is substantially filled with elastomeric material.

10. A safety device for use in combination with a ski lift apparatus having a main support, at least one beam carried by the support, a rope-carrier assembly mounted on the beam and including at least two peripherally grooved sheaves, a continuous rope carried by the assembly for translation in the direction of the longitudinal axis of the rope, and a vehicle carrier having a generally vertical hanger bar provided at its upper end with a laterally extending hanger arm fixedly secured at its free end to the rope, the device comprising:

a rope guard mechanism having a base formed to be connected to the beam in predetermined position and attitude;

a plurality of guard fingers movably mounted on the base in such a position that their free ends will be located adjacent to the rope carrier assembly at the side remote from the main support and spaced laterally from the upper outer margin of at least one of the sheaves a distance substantially less than the diameter of the rope to positively prevent the rope from falling outwardly from the assembly;

the guard fingers lying in a generally vertical plane and being adapted to be located in the path of travel of the hanger arm and being displaceable by contact of the arm about their moveable connections with the base in the direction of the movement of the arm;

a safety sheave, carried by a bracket formed to be mounted on the beam, is provided in addition to the primary rope carrying sheaves and is arranged to be located with its upper margin below their upper margins in a position at the side of the primary sheaves remote from the main support to catch the rope upon displacement from the primary sheaves;

the rope guard mechanism is formed to be so located that the guard fingers will be outwardly adjacent to the safety sheave; and a guide member is fixed on the sheave-holding bracket and slopes outward and downward to the inner upper edge of the safety sheave to guide a falling rope into the groove of the safety sheave.

* * * * *